United States Patent [19]

Morris

[11] 4,384,717

[45] May 24, 1983

[54] MOBIUS STRIP PUZZLE

[76] Inventor: Daniel L. Morris, 1202 - 8th Ave. W., Seattle, Wash. 98119

[21] Appl. No.: 320,549

[22] Filed: Nov. 12, 1981

[51] Int. Cl.[3] ..... A63F 9/10

[52] U.S. Cl. ..... 273/156; 46/1 R; 272/8 R; 428/542.2; 434/211

[58] Field of Search ..... 273/155, 156, 157 R; 46/1 R; 272/8 R; 428/542.2; 434/211

[56] References Cited

U.S. PATENT DOCUMENTS

| | | | |
|---|---|---|---|
| 3,884,462 | 5/1975 | Rebajes | 272/8 R |
| 4,083,123 | 4/1978 | Livermore | 273/157 R |
| 4,214,747 | 7/1980 | Rebajes | 272/8 R |

*Primary Examiner*—Anton O. Oechsle

*Attorney, Agent, or Firm*—Christensen, O'Connor, Johnson & Kindness

[57] ABSTRACT

A plural-loop Mobius strip loop puzzle having multiple twist component loops which are linked with each other and which have mating continuous edges with associated edge fasteners to permit assembling and disassembling a single composite Mobius strip loop.

8 Claims, 5 Drawing Figures

MOBIUS STRIP PUZZLE

BACKGROUND OF THE INVENTION

This invention relates to an interesting and challenging educational puzzle employing the concept of the well known Möbius (hereinafter "Mobius") strip or band that has been defined in classical dictionary terms as a one-sided surface constructed from a rectangle by holding one end fixed, rotating the opposite end through 180 degrees, and applying it to the first end. The invention is herein illustratively described by reference to the preferred form thereof; however, it should be understood that modifications may be employed without departing from the essential features involved.

The Mobius strip or band has long been known as a fascinating geometric figure. Made of paper ribbon or other ribbon material, it has been known, for example, that a Mobius strip can be cut in half longitudinally to produce a single strip of twice the length, half the width and with an additional twist beyond the characteristic single twist.

The present invention is directed to the provision of a novel, unique and educational puzzle made up of parts that can be put together and taken apart, respectively, and the doing of which will be challenging to persons of varying ages and backgrounds, and one that in the preferred form, as herein disclosed, becomes especially, although not unduly, challenging to interested persons.

SUMMARY OF THE INVENTION

As disclosed, in its preferred form, the puzzle of this invention comprises two Mobius component strip loops linked together and joined continuously by fastener means along mating longitudinal edges to form a wider composite Mobius strip half the length of the component strips. The preferred fastener means comprise slide fasteners operable to interconnect and disconnect such edges. The participant working the puzzle can use the slide fasteners to convert the puzzle configuration back and forth between a relatively short composite Mobius strip loop made up of a number of width increments and a relatively narrow but longer Mobius strip loop, or between one or the other of those configurations and a much more complex puzzle form comprising two Mobius strip loops linked together. In one such state of disassembly, a short loop, the length of the fully assembled composite and narrowed by a width increment, is linked with a narrow loop twice the length. In another such state of disassembly, the short loop is also of dual length while being further narrowed by an increment and linked with the narrow dual length loop just mentioned.

While not shown herein, still other width increment loops, one or more, may be disconnectably added in similar manner if so desired, but in so doing, the puzzle becomes extremely complicated to work, so much so that the pleasure of an attainable challenge in the use may give way to less desirable responses.

DETAILED DESCRIPTION REFERENCED TO THE DRAWINGS

Figure 1:
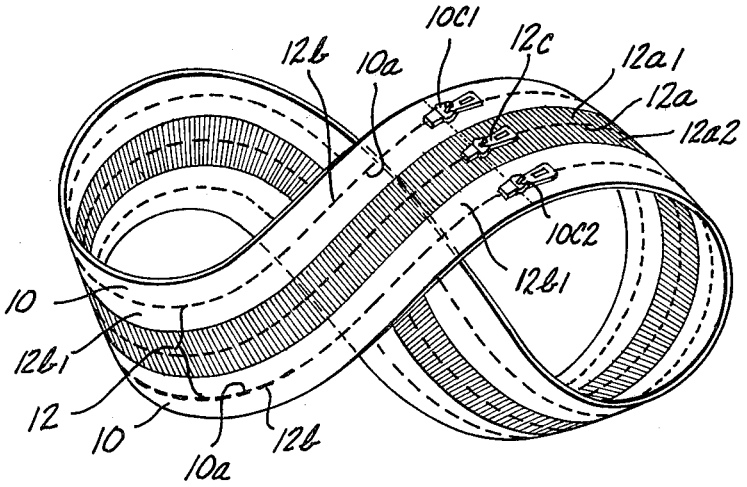
FIG. 1 depicts in perspective the dual-strip, preferred embodiment assembled in its composite configuration, as a classic Mobius band.

In the drawings, the Mobius strip loop puzzle components are fastened together releasably along the strip edges using slide fasteners (i.e., sometimes referred to as "zippers"). In fact, the illustrative embodiment serving as the preferred embodiment is formed essentially in its entirety by sewing together the free edges (i.e., those opposite the series of slide fastener clips) of the fabric webbing strips of commercially available slide fasteners. In ordinary commercial use, such slide fasteners are sewn into the panel edges of sleeping bags, jackets and other fabric articles. Slide fasteners, therefore, are the preferred and considered the most practical, inexpensive, durable and otherwise advantageous type of edge fastener means for use in the invention. Indeed, the use of such components as the strip components carrying their own fastener means constitutes an important specific feature of the invention in its preferred embodiment. At the same time, however, it will be recognized that in broad principle, at least, other kinds of edge fastener means may be employed for securing together and for releasing the puzzle's mating strip loop edges in repeated workings of the puzzle.

Figure 5:
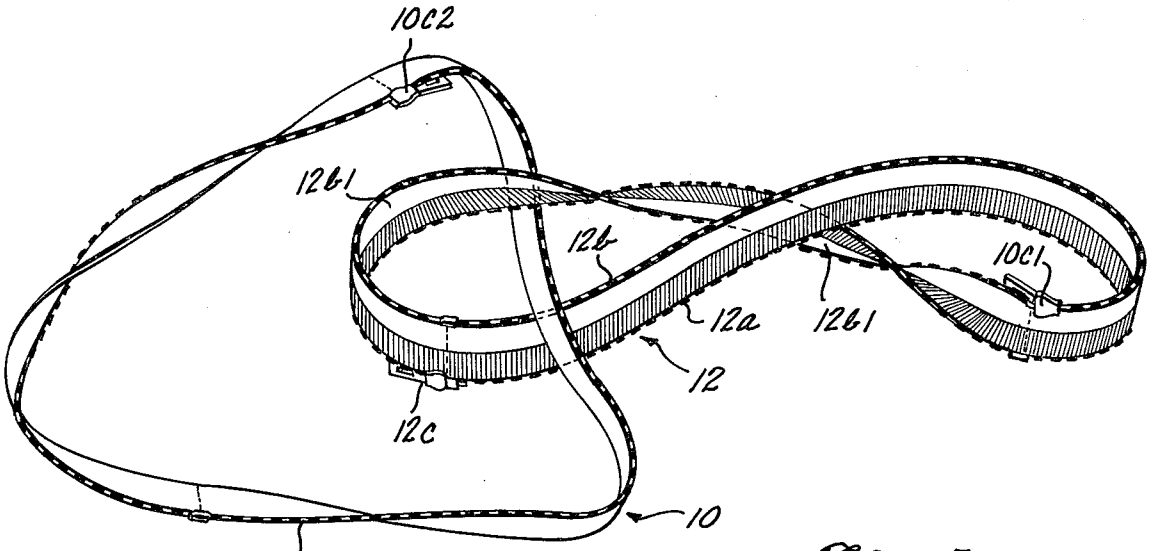

In FIG. 1, the fully assembled composite Mobius strip loop is made up of two component loops doubled in width, halved in length, edge-abutted and disconnectably fastened together and to themselves along those edges. The puzzle's component strip loops may best be seen and recognized for themselves in FIG. 5 wherein the puzzle appears in its ultimately disassembled configuration. In that figure, one loop is identified as 10 and the other as 12. If desired, they may be of different colors to distinguish one from the other. Each loop in this disassembled configuration will be seen as extending to twice the length of the assembled puzzle composite loop of FIG. 1 and as having not the single twist of the FIG. 1 composite, but additional twists. In the case of loop 12, a loop with component slide fasteners **12*a* and 12*b* extending the length of both of its opposite edges (i.e., two commercial type slide fasteners sewn together free edge-to-free edge), the extended loop as shown in FIG. 5 inherently exhibits two twists. In the case of loop 10, a loop with a slide fastener 10*a* extending the length of but one edge, the extended loop as shown in FIG. 5** inherently exhibits four twists.

Figure 3:
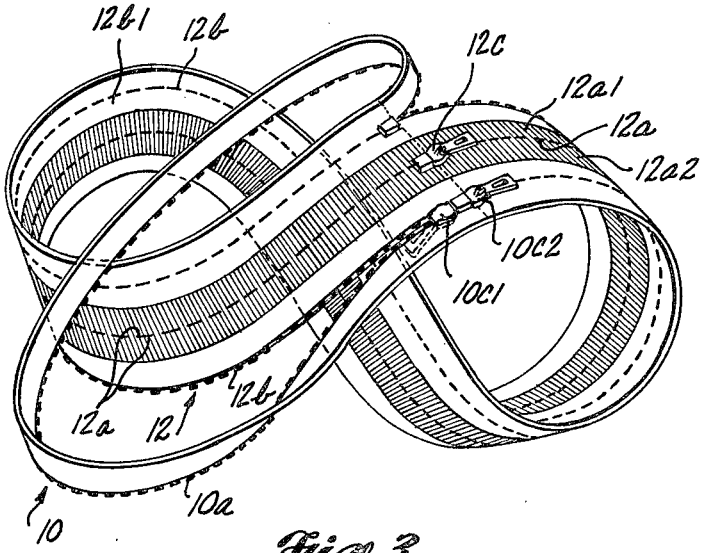
FIG. 3 is a perspective view of the same puzzle composite of FIG. 1 in process of conversion into a different subassembled configuration as shown in FIG. 4, and which, in turn, can be further and most fully disassembled into the ultimate takedown configuration depicted in FIG. 5.
Figure 4:
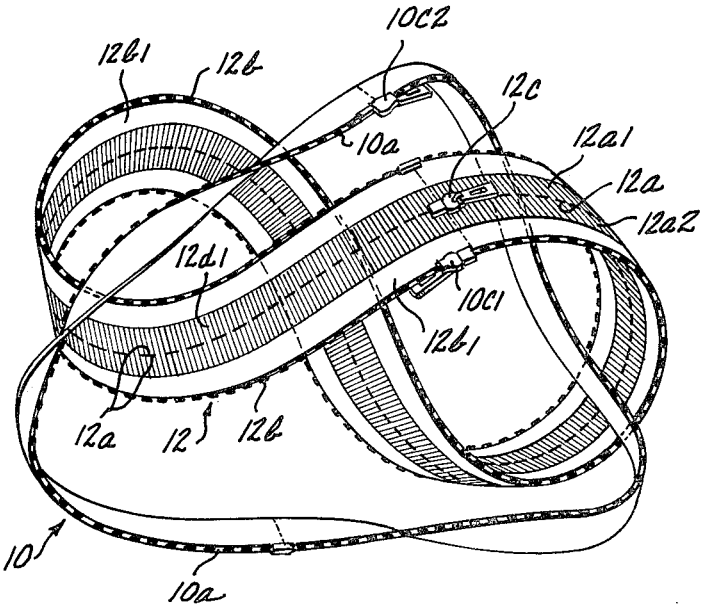

In FIG. 4, the subassembled configuration is one in which component loop 10 is disconnected along its full length from component loop 12 and thus fully extended in length (i.e., not doubled or coiled back upon itself) whereas loop 12 remains doubled with the mating edges of its halves still fastened together. In FIG. 3, disconnection of the loop 10 is partially completed as a step toward conversion from the puzzle form shown in FIG. 1 to that shown in FIG. 4.

Figure 2:
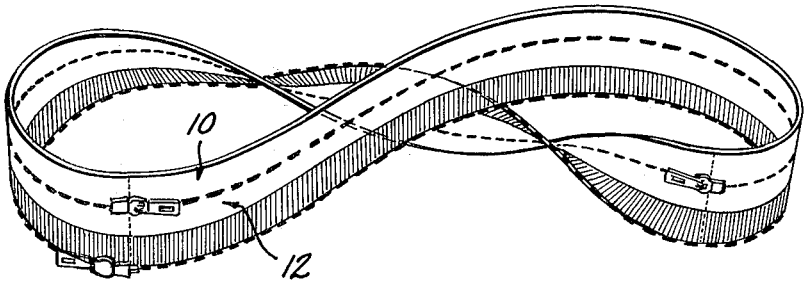
FIG. 2 is a perspective view of the same puzzle composite partly disassembled by full-length disconnection of one of the continuous edge fasteners to form a dual-length, narrower single loop.

In FIG. 2, the composite puzzle of FIG. 1 has been converted to a configurational state wherein component loop 10 remains attached to component loop 12 along the full length of each and wherein the half-length portions of loop 12 are unfastened from one another so as to extend the length of the resultant loop to twice the length of the fully assembled composite of FIG. 1, and thereby the length of component loop 10 with it.

In the fully assembled form (FIG. 1) of the preferred construction of the composite and of the component loops making it up, both loops 10 and 12 have fastener strip ends transversely aligned. As stated previously, component loop 12 is provided with slide fasteners along both longitudinal edges by the practical expedient of sewing together the free longitudinal edges of two commercial-production fabric webbing slide fastener halves (i.e., "halves" in the sense that such slide fasteners require dual strips with mating clip series). This makes strip 12 almost twice the width of strip 10 (i.e., full twice the width except for sewing overlap). Referring to FIG, 1, then, component loop 12 is formed widthwise by the permanently edge-joined slide fastener webbing strips **12*a*1 and 12*b*2. A first series of fastener element clips, 12*a*, extends along one "outer" edge of dual-width loop 12 and a second series of fastener element clips 12 along its opposite edge. The strip loop 10 has fastener element clips 10*a*** along just one edge.

First and second slide fastener sliders **10*c*1 and 10*c*2 initially are transversely aligned with central slider 12*c* in starting position with the slide fasteners fastened together over their full lengths (FIG. 1). In order to disconnect loop 10 over its full length, sliders 10*c*1 and 10*c*2 are operated in tandem, and thereby over a double-length run in total. However, operating only the one slider 12*c* and over a single-length run disconnects the half-lengths of loop 12 from each other, as in FIG. 2 (assuming loop 10 remains fastened to loop 12**).

While a single dual-length commercial fastener could be used to make up the full length of loop 10 and the full length of the associated side half of loop 12, it is preferred they be made up of two equal length commercial slide fasteners so that the same commercially available length slide fasteners used for loop 12 (two in number) may also be used for loop 10. Typically, 22" length fastener strips are used, but length (or width, for that matter) is in no sense critical.

Having illustratively described the novel Mobius strip puzzle in its presently preferred form and degree of complexity (i.e., in terms of the number of successive loops incorporated therein), it will be appreciated that modifications and variations are possible within the scope of the invention as defined in the claims that follow.

The embodiments of the invention in which an exclusive property or privilege is claimed are defined as follows:

1. The Mobius strip loop puzzle comprising a composite Mobius strip loop having at least two separable mating edges extending continuously the length thereof having cooperable edge fastener means extending the lengths of such edges to permit disconnecting and reconnecting such edges along substantially their full length.

2. The Mobius strip loop puzzle defined in claim 1 comprising a plurality of individual continuous component strip loops of equal length linked with each other and each adapted to be doubled into two coils of half the length, one of said loops having edge fasteners along opposite edges and the other along one edge operable to disconnect and reconnect the half-length coils of one loop to each other to form a wider single coil loop and an edge of the other loop to said one loop to form a composite still wider single coil loop.

3. The Mobius strip loop puzzle defined in either of claims 1 or 2 wherein the loops comprise fabric band slide fastener strips, the fastener elements of which form the mating edges with edge fasteners thereon.

4. A Mobius strip loop puzzle comprising a first Mobius strip loop having the characteristic Mobius twist therein plus a second similar twist, and mutually complemental fastener means respectively extending substantially continuously over first and second halves of the length of an edge of said strip loop and operable to releasably join the first half to the second half in mutual registry with said loop doubled, coiled upon itself, thereby forming a composite wider Mobius strip loop half the length of said first loop and with a single twist in said composite loop.

5. The puzzle defined in claim 4 wherein the opposite outer edges of the composite wider Mobius strip loop have respective outer edge fastener means extending along substantially the full lengths thereof, and a second continuous strip loop linked with the first loop and having fastener means extending along substantially the full length of one edge of said second strip loop and half of the length of which is adapted to releasably join the outer edge fastener means on one such outer edge of the first loop and the other half of the length of which is adapted to releasably join the outer edge fastener means on the other such outer edge of the first loop, thereby to permit forming a still wider composite Mobius strip loop the length of said first-mentioned wider composite loop.

6. The Mobius strip loop puzzle defined in either of claims 4 or 5 wherein the fastener means comprise flexible strip slide fasteners, the clip series elements of which provide the mating edges of the loops.

7. The Mobius strip loop puzzle defined in either of claims 4 or 5 wherein the fastener means comprise flexible strip slide fasteners, the clip series elements of which provide the edges of the loops and the strips of which form the respective loops themselves.

8. The Mobius strip loop puzzle defined in either of claims 4 or 5 wherein the edge fastener means comprise continuously interengageable and disengageable fastener elements extending substantially the full length of the respectively associated edges.

* * * * *